US005238472A

United States Patent [19]

Pfister et al.

[11] Patent Number: 5,238,472

[45] Date of Patent: Aug. 24, 1993

[54] PARTICLE FILTER THAT CAN BE REGENERATED BY BURNING FREE FOR THE EXHAUST GASES OF INTERNAL COMBUSTION ENGINES

[75] Inventors: Wolfgang Pfister, Esslingen; Herbert Langen, Altbach, both of Fed. Rep. of Germany

[73] Assignee: J. Eberspacher, Esslingen, Fed. Rep. of Germany

[21] Appl. No.: 862,319

[22] Filed: Apr. 2, 1992

[30] Foreign Application Priority Data

Apr. 5, 1991 [DE] Fed. Rep. of Germany ..... 4111029

[51] Int. Cl.[5] ..... B01D 46/04

[52] U.S. Cl. ..... 55/269; 55/282; 55/379; 55/523; 55/DIG. 30; 60/303; 60/311

[58] Field of Search ..... 55/282, 379, 523, DIG. 30, 55/341.6, 269; 60/303, 311

[56] References Cited

U.S. PATENT DOCUMENTS

| | | | |
|---|---|---|---|
| 2,255,519 | 9/1941 | Preston | 55/341.6 X |
| 3,431,709 | 3/1969 | Kawanami | 55/379 X |
| 3,775,064 | 11/1973 | Berger et al. | 60/303 X |
| 4,205,971 | 6/1980 | Abthoff et al. | 55/523 X |
| 4,283,207 | 8/1981 | Martyniuk | 55/282 |
| 4,390,354 | 6/1983 | Witchell . | |
| 4,398,931 | 8/1983 | Shevlin | 55/379 X |
| 4,419,113 | 12/1983 | Smith | 55/DIG. 30 X |
| 4,628,689 | 12/1986 | Jourdan | 55/DIG. 30 X |
| 4,634,459 | 1/1987 | Pischingen et al. | 55/DIG. 30 X |
| 4,788,819 | 12/1988 | Henkel | 60/303 |
| 5,138,836 | 8/1992 | Pfister | 55/484 X |

FOREIGN PATENT DOCUMENTS

3836697A1 5/1990 Fed. Rep. of Germany .

*Primary Examiner*—Charles Hart
*Attorney, Agent, or Firm*—McGlew and Tuttle

[57] ABSTRACT

A particle filter for the exhaust gases of internal combustion engines is described, which can be regenerated by burning free, and in which the filter cartridges (12) include a support tube (16) with a lining of filter material (20). The support tubes 16 are conical. The lining with filter material (20) is preferably carried out such that the filter cartridge (12) has a cylindrical shape, i.e., the filter material (20) lining is thicker on the inlet side than on the outlet side. However, lining with an equal thickness of filter material (20) over the entire length of the conical part of the filter cartridge (12) is also shown.

17 Claims, 4 Drawing Sheets

PARTICLE FILTER THAT CAN BE REGENERATED BY BURNING FREE FOR THE EXHAUST GASES OF INTERNAL COMBUSTION ENGINES

FIELD OF THE INVENTION

The present invention pertains to a particle filter for cleaning the exhaust gases of internal combustion engines and more particularly to such a particle filter with filter cartridges, which are arranged in a housing provided with an inlet chamber and an outlet funnel between mounting plates, and which are formed by a support tube that is provided with exhaust gas passage openings and is lined with filter material, and to which heat is additionally supplied from a heat source for regeneration by burning free.

BACKGROUND OF THE INVENTION

Such particle filters are needed for cleaning the exhaust gases of internal combustion engines, especially in vehicles operated with diesel fuel, in order to filter out the soot particles, which are hazardous for health and cause a high level of hazardous environmental pollution. The soot separators, which are also often incorrectly called filters, should be distinguished from these particle filters; in these soot separators, when used in exhaust gas treatment units of motor vehicles, the soot is separated from the exhaust gas stream while it flows through a housing, e.g., by deflection and guidance through a filter-like lining, and is subsequently collected in a collection chamber. These soot separators require periodic emptying of the collection chamber and are therefore unsuitable for continuous operation, e.g., in utility vehicles, Such a soot separator is disclosed in, e.g., German Utility Model No. DE-GM 86,00,167.

Various embodiments of particle filters suitable for driving operation have been known. In one embodiment, the exhaust gas is filtered while it is passing through a ceramic block (monolith), which has a plurality of passage canals, of which one canal each is closed on the inlet side and another canal is closed on the outlet side in a checkerboard pattern, so that the exhaust gas flows into one canal, after which it flows into the adjacent canal through the surrounding monolith section acting as a filter, and leaves it, freed of soot particles. Such a soot filter is disclosed in, e.g., German Offenlegungsschrift No. DE-OS 32,17,357.

Another embodiment uses filter cartridges for the particle filtration. These filter cartridges are preferably designed as wound filters. Several layers of threads of a filter material are wound around a support tube, provided with exhaust gas passage openings, so that an element comparable to a textile thread spool is formed. Such an arrangement is disclosed in, e.g., German Offenlegungsschrift No. DE-OS 38,15,148, in which the mounting of the filter cartridges in mounting plates is described, in particular. The filter cartridges may also be formed by a tube of filter material pulled over a support tube corresponding to German Offenlegungsschrift No. DE-OS 38,23,205. The exhaust gas to be cleaned passes through the filter cartridges from the outside to the inside, and it passes through the filter material into the support tubes that are closed on the inlet side; the soot particles are retained during the passage of the exhaust gas through the wound filter material; the cleaned exhaust gas flows through the support tubes and into the discharge funnel, and is removed from there. The filter cartridges are of uniform design. It is also possible to arrange a mounting grid instead of the inlet-side mounting plates provided with exhaust gas passage openings.

Soot buildup occurs, i.e., the filter material is increasingly clogged by soot particles, during the operation of the internal combustion engine, and the soot must be removed after a relatively short operating time. Mechanical removal is ruled out for practical reasons, because it would make it necessary to demount the entire filter and remove the soot from it. It is therefore necessary to resort to burning free the accumulated soot. To do so, in a process that is employed in practice, oxidizing agents are provided as additives to the exhaust gas from a storage container, so that the soot collected comes into contact with these agents, which lower its ignition point and increase the rate of combustion, and can be burned off at a relatively low exhaust gas temperature. However, this manner of burning free the soot collected has the disadvantage that the additives are chemical compounds which are readily inflammable, and the exhaust gas will be enriched in undesired components, whose environmental safety has not yet been proven. Therefore, attempts have been made to connect a diesel burner as an external heat source, but it was impossible to regenerate the filters with the prior-art arrangement during the driving operation of the vehicle. Therefore, this solution requires the use of very large filters to obtain a storage capacity that permits a rather long driving operation between the phases of regeneration. This resting-phase regeneration is possible in vehicles which operate intermittently, e.g., buses used in inner-city transportation. In other vehicles, regeneration must be carried out during driving operation. For example, two filters are arranged in parallel to one another for this purpose, and one of the two filters is alternatingly regenerated.

If only one particle filter with a plurality of filter cartridges is used, it is only possible to connect—as soon as a thicker coating with soot particles is determined, e.g., from the exhaust gas counterpressure—an external heat source, which heats the exhaust gas to be cleaned (>600° C.) to the extent that the burning-free process can take place. However, it was found that the filter cartridges are not burned free over their entire length, especially in load states with limited exhaust gas flow. This is due to the fact that even during burning free, for example, the front half of the filter cartridges provides for a sufficiently low flow resistance so that the flow through the rear part or the outermost filter cartridges is insufficient. This incomplete regeneration leads to increasingly shorter soot buildup times, which may lead to failure of the filter in the worst case. Experiments have shown that the soot buildup time decreased from, e.g., 135 minutes at the time of the first soot buildup to 15 to 20 minutes.

To achieve a substantial improvement during regeneration by burning free, an improvement of regeneration by burning free has been achieved according to DE 40,04,861 A1 by arranging—in the space between the filter cartridges—so-called overflow tubes, via which the exhaust gas to be cleaned is fed in such that uniform admission over the entire length of the filter cartridge is achieved.

DE 38,36,697 A1 discloses a device of this class, in which the mounting plates and the filter cartridges form a rotatable drum, so that one segment of this drum can always be brought into a zone in which burning free takes place. Such a device is very expensive, especially in terms of the mounting of the rotatable drum and the sealing against the bypassing of non-cleaned exhaust gas. These problems are solved in this document. However, such devices in which burning free takes place segment by segment are unsuitable for mass-production installation.

Furthermore, German Patent Application No. P 40,26,275.4, which had not previously been published, discloses a particle filter of this class, in which filter cartridges of different active lengths are arranged distributed at equal distances from one another over the cross section of the housing. The "active length" is defined as the section of the filter cartridge lined with filter material. A different active length can be achieved by making the filter material lining different over the length of the filter cartridge, e.g., making it thicker at the front when viewed in the direction of flow than in the area following the front area. This lining of different thickness may be different in the individual filter cartridges. For example, it is possible to select a different lining in the edge zone of the filter than in the central (middle) area. The thickness of the lining may be selected according to the flow profile of the exhaust gas to be cleaned. This arrangement requires filter cartridges with different linings for each filter, which makes it necessary to stock a large amount of filter cartridges.

SUMMARY AND OBJECTS OF THE INVENTION

Based on this state of the art, the primary object of the present invention is to provide a particle filter which makes possible regeneration during driving operation and in which a high degree of burning-free is achieved over the entire length of the filter to which exhaust gas is admitted over the entire cross section of the filter, and uniform filter cartridges are used, so that the time elapsing until repeated soot buildup occurs is approximately constant and corresponds to the time elapsing before the first soot buildup.

This task is accomplished with a particle filter in accordance with the invention in which the support tube expands from a smaller diameter to a larger diameter. Cylindrical pipe connections on the support tubes are used for fastening in mounting plates. It was found to be advantageous for the opening angle alpha of the support tube jacket to be between 2° and 10°, and an opening angle of 3°-5° was found to be particularly advantageous. It is particularly advantageous for the transition from the inlet-side, smaller diameter to the outlet-side, larger diameter to be continuous, but the transition may also take place in discrete steps. In this embodiment, the internal diameter of each subsequent step is equal to the external diameter of the respective preceding step. This offers the advantage that, especially if the differences in the diameters are not too large, assembly from individual, cylindrical sections, which can be produced with ease, is possible, and the individual tubes can be stocked. In addition, the exhaust gas passage openings (round or as slots) can be easily introduced into these individual tubes. Lining the support tube, provided with exhaust gas passage openings, with filter material, in such a way that the filter cartridge formed by the support tube and the filter material will have a cylindrical shape, has proved to be particularly advantageous for forming the filter cartridges formed by the support tube with filter material lining. This embodiment offers substantial advantages over a simpler embodiment, in which the support tube is lined with one filter material layer of equal thickness. To achieve flow through the filter cartridges from the outside to the inside, the support tubes are closed on one side. The exhaust gas to be cleaned will thus enter, in the known manner, through exhaust gas passage openings in the inlet-side mounting plate. In this arrangement, the inlet side of the filter cartridge is closed, and the outlet-side mounting plate has no exhaust gas passage openings. If exhaust gas flow in the opposite direction from the inside to the outside is desired, the inlet side of the filter cartridge is open and its outlet side is closed, and the inlet-side mounting plate is a closed plate, while the outlet-side mounting plate has exhaust gas passage openings. In this case, the filter cartridge is mounted inverted, i.e., with the larger diameter on the inlet side.

The conical design of the support tube according to the present invention, has a preferred embodiment with a compensating filter material lining wherein the support tube is lined with filter material such that the filter cartridge formed by the support tube and the filter material has a cylindrical outer shape even though the inner support tube expands from a smaller diameter to a larger diameter. This leads to a particle filter in which the flow resistance of the filter cartridges, in the direction of flow through the filter, in the outlet-side area and in the non-loaded state of the filter is lower than in the inlet-side area. As a result, the exhaust gas mass flow is higher in the rear, outlet-side area of the filter, as long as an equilibrium has become established due to the soot coating. During the regeneration by the external heat supplied by, e.g., a connected burner, the inlet-side, front area is also first heated and regenerated. Based on the unequal flow resistance along the filter, the outlet-side, rear area of the filter is passed through by more hot exhaust gas and is therefore also completely regenerated. The fact that the exhaust gas volume flow increases along the filter cartridge is taken into account in dimensioning the conical support tube according to the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIGS. 1 through 3 show a simplified and schematic representation of an exemplified embodiment wherein:

FIG. 1 is a longitudinal sectional view taken through a particle filter with various possibilities of exhaust gas guiding in the upper and lower halves;

FIG. 2 is a cross sectional view taken through line II—II of FIG. 1;

FIG. 3 is a longitudinal sectional view of a variant of the filter cartridge.

DETAILED DESCRIPTION OF THE PREFERRED EMBODIMENTS

Figure 1:
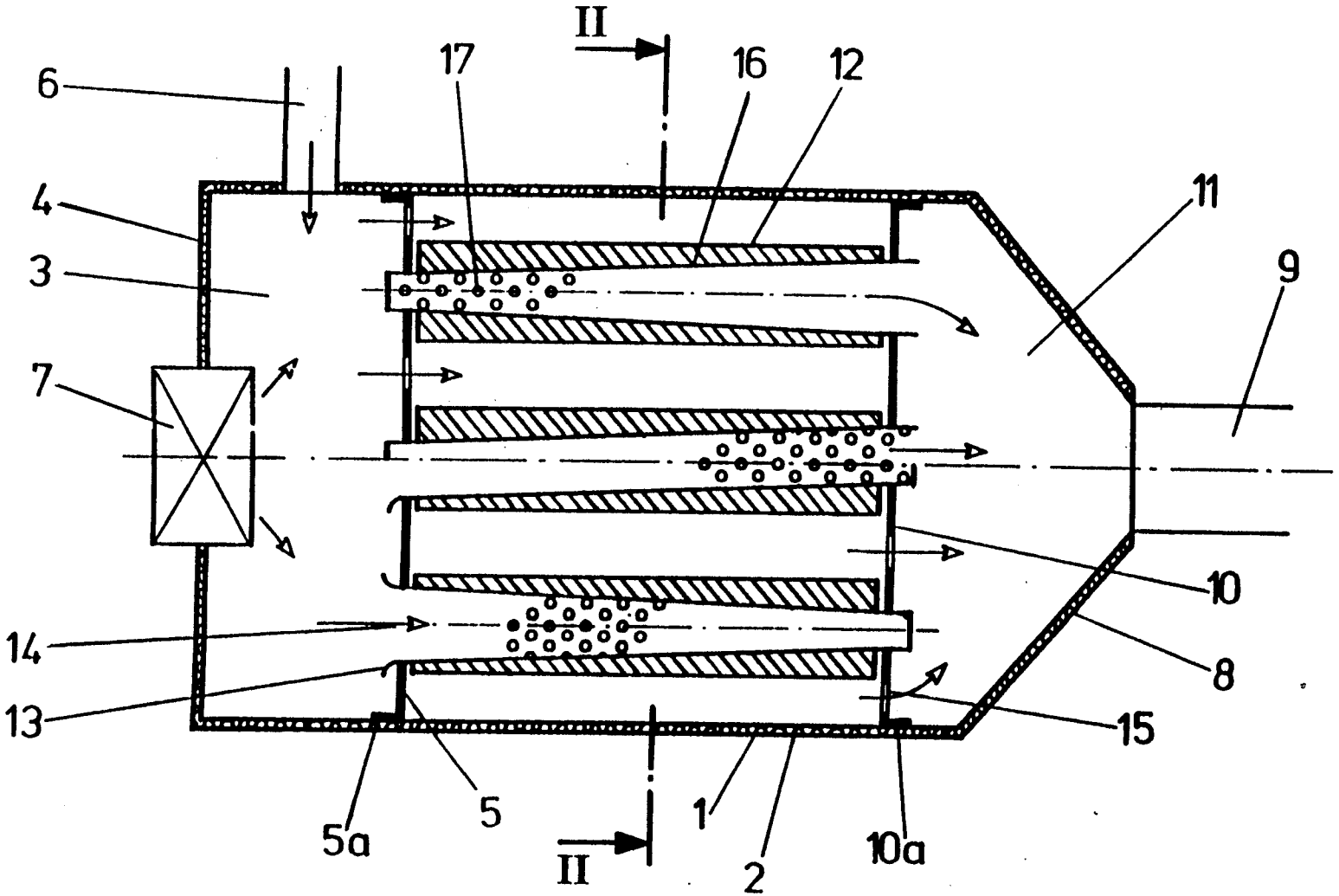

The two possibilities of flow through the filter cartridges are shown in the embodiment according to FIG. 1. Flow from the outside to the inside is shown in the top half of FIG. 1, and flow from the inside to the outside is shown in the lower half. The embodiment shown in the upper half is a preferred embodiment.

Referring to FIG. 1 in particular, a housing 1 is shown with thermal insulation 2. The thermal insulation 2 has the task of preventing heat radiation, in order to maintain the burning-free temperature with the lowest possible external heat supply and to protect the components surrounding the particle filter from needless heating. In the front when viewed in the direction of flow (on the inlet side), the housing 1 has a first chamber 3 acting as a mixing chamber, which is formed by the front side 4 of the said housing 1 and an inlet-side mounting plate 5, and on which an exhaust gas inlet pipe connection 6 is arranged, preferably radially or tangentially (with respect to the circular walls forming chamber 3). A connection 7 for the necessary supply of external heat is also provided on the front side 4. The connection 7 also schematically represents a suitable burner mounted directly on the front side 4. Such a suitable burner is shown in, e.g., DE 34,10,716 A1. One example of external heat supply at 7 is shown in, e.g., DE 35,45,437 A1. On the downstream (outlet) side, the housing 1 shows a conical part 8, which is joined by an exhaust gas outlet pipe connection 9. An outlet-side mounting plate 10 is arranged in the housing 1 on the downstream side, so that a second chamber 11 is formed between this outlet-side mounting plate 10 and the conical part 8. Both the first chamber 3 and the second chamber 11 may be subdivided by intermediate plates (not shown) with exhaust gas passage openings, which may be advantageous especially in the first chamber 3 in order to separate a front mixing chamber from a subsequent exhaust gas feed or distribution chamber.

The inlet-side mounting plate 5 is preferably permanently arranged in the housing 1, e.g., by means of an angle ring 5*a* made in one piece with it, but it may also be arranged, in the case of a divided housing, between flanges of the housing. The outlet-side mounting plate 10 may also have an angle ring 10*a* made in one piece with it. To absorb heat-induced changes in length, the outlet-side mounting plate 10 with its angle ring 10*a* made in one piece with it is arranged, in a preferred embodiment, in a sliding fit in the housing 1. However, it may also be arranged permanently if the individual filter cartridges 12 are arranged movably, e.g., in the outlet-side mounting plate 10.

As is shown in the lower half of FIG. 1, one inlet bell 13 may be arranged at the exhaust gas inlet openings 14 of the mounting plate 5, and flow-guiding elements may be arranged at the outlet-side mounting plate 10 (not shown in FIG. 1). The outlet-side mounting plate 10 also has exhaust gas passage openings 15, from which the exhaust gas is removed via the second chamber 11 and the exhaust gas outlet connection pipe 9.

Figure 3:
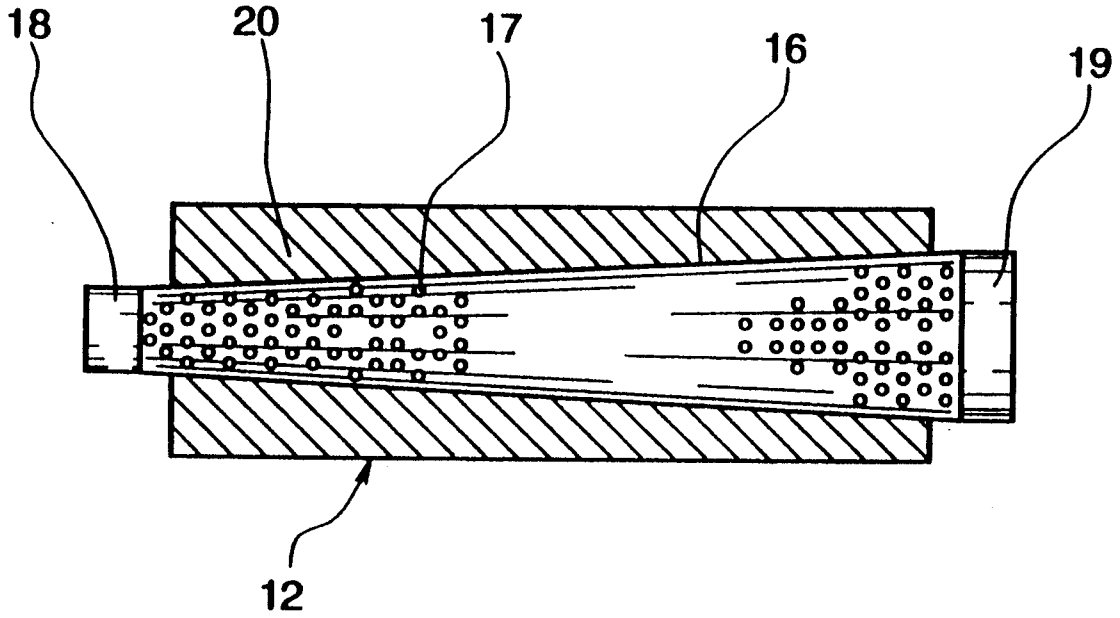

The filter cartridges 12 designed according to the present invention are arranged between the mounting plates 5 and 10. These are formed by a support tube 16, which has, over its length, exhaust gas passage openings, which are preferably round, but may also be designed as slots. The support tube 16 is designed as a conical tube; according to the top half of FIG. 1, it has a smaller diameter on the inlet side than on the outlet side. A cylindrical connection piece 18 may be made in one piece with it on the inlet side and a cylindrical connection piece 19 may be made in one piece with it on the outlet side (see FIG. 3). The filter cartridges 12 are mounted in the mounting plates 5 and 10 with the connection pieces 18/19 and fastened at least on the inlet side (18 in 5), while the outlet-side mounting (19 in 10) may be designed as a sliding fit. The support tube 16 is lined with filter material in its conical zone. The lining is prepared such that the filter cartridge 12 will have a cylindrical shape, i.e., the filter material lining is thicker on the inlet side than on the outlet side.

Figure 4:
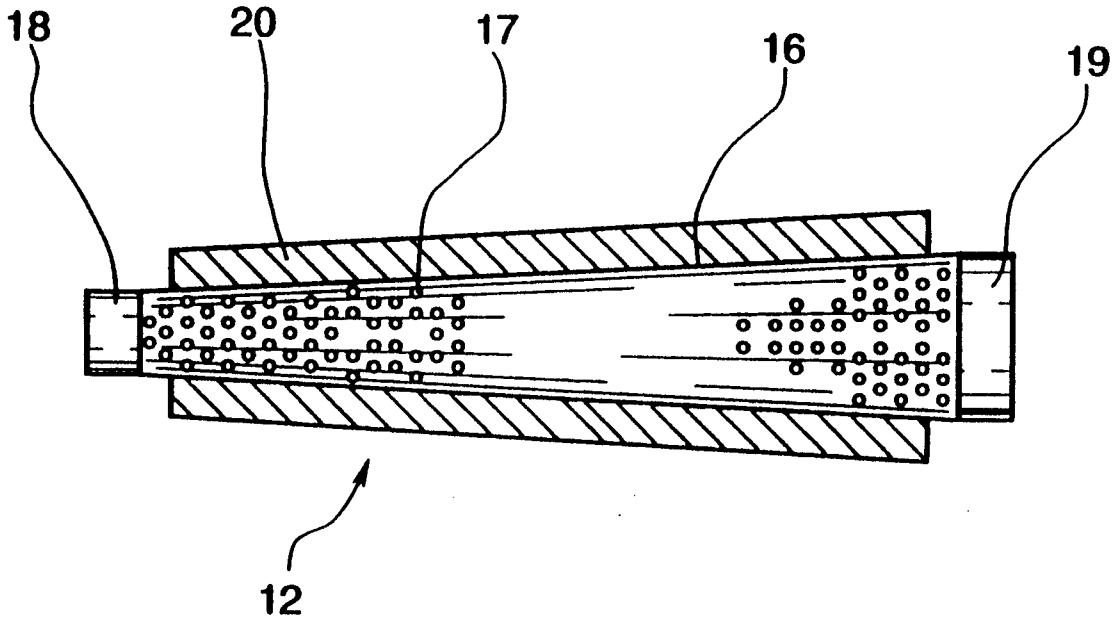
FIG. 4 is a longitudinal sectional view similar to FIG. 3 showing another variant of the filter cartridge.

However, another variant is also possible, which is intended for smaller exhaust gas flow rates; according to this variant, the support tube is lined uniformly with filter material. This variant is shown in FIG. 4. In a tested embodiment, the filter cartridge 12 has the following dimensions: Inlet-side diameter 15 mm, outlet-side diameter 34 mm, length 300 mm, diameter of the exhaust gas passage openings in the support tube 3 mm, external diameter of the filter material lining 48 mm.

Figure 2:
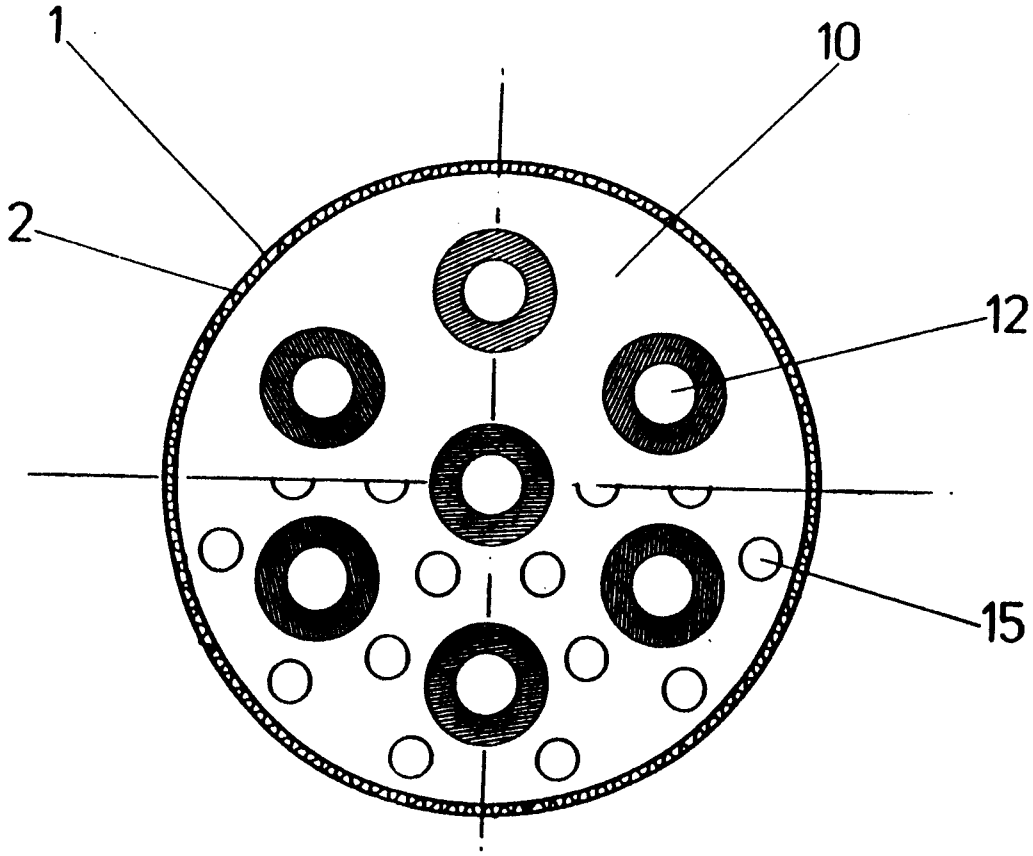

As can be recognized from FIG. 2, the filter cartridges 12 are arranged at equal distances from one another over the diameter of the housing 1.

In the arrangement according to the upper half of FIG. 1, the support tubes 16 are closed on the inlet side (inlet side end face) and open on the outlet side. The exhaust gas to be cleaned is fed into the free space between the filter cartridges 12 via the exhaust gas passage openings 14 in the inlet-side mounting plate 5, flows through the filter cartridges 12 from the outside to the inside, and leaves the filter cartridges 12 via their open outlet side.

In the arrangement according to the lower half of FIG. 1, the support tubes 16 are open on the inlet side and closed on the outlet side (outlet side end face), and staggered through 180° relative to the representation in the top half, i.e., they are arranged "inverted." The exhaust gas to be cleaned flows directly into the filter cartridges 12, flows through them from the inside to the outside, passes over into the second chamber 11 via the exhaust gas passage openings 15, and is removed from there via the exhaust gas outlet pipe connection 9.

While specific embodiments of the invention have been shown and described in detail to illustrate the application of the principles of the invention, it will be understood that the invention may be embodied otherwise without departing from such principles.

We claim:

1. A particle filter for cleaning exhaust gas of an internal combustion engine comprising: a housing including a first mounting plate within the housing and cooperating with the housing to define an inlet chamber, and a second mounting plate within the housing, and cooperating with the housing to define an outlet chamber; filter cartridges arranged supported between said first mounting plate and said second mounting plate, said filter cartridges comprising a support tube provided with exhaust gas passage openings, said support tube expanding from a smaller diameter adjacent one end to a larger diameter adjacent a second end, and said filter cartridges including filter material supported by said support tube and lining said support tube; and heat source means for supplying heat to said filter cartridges for regeneration of said filter cartridges by burning free.

2. A particle filter according to claim 1, wherein said support tube comprises a jacket having an opening angle, defining an expanded portion from said smaller diameter to said larger diameter of 2°-10°.

3. A particle filter according to claim 1, wherein an opening angle of said support tube is 3°-5°.

4. A particle filter according to claim 1, wherein said support tube includes a transition zone from said smaller diameter to said larger diameter which is continuous.

5. A particle filter according to claim 1, wherein said support tube includes a transition zone between said smaller diameter and said larger diameter, said transition zone including a plurality of steps wherein an internal diameter of each subsequent step is equal to an external diameter of a preceding step.

6. A particle filter according to claim 1, wherein said support tube is lined with said filter material such that said filter cartridge formed by said support tube and said filter material has a cylindrical external shape.

7. A particle filter according to claim 1, wherein said support tube is lined with said filter material such that a layer or equal thickness of filter material is provided between said smaller diameter and said larger diameter.

8. A particle filter according to claim 1, wherein said support tube includes a closed inlet side end face.

9. A particle filter for cleaning exhaust gas of an internal combustion engine, the filter comprising;

a housing defining an inlet pipe connection and an outlet pipe connection;

an inlet mounting plate positioned inside said housing and cooperating with said housing to define an inlet chamber in communication with said inlet pipe connection;

an outlet mounting plate positioned inside said housing and cooperating with said housing to define an outlet chamber in communication with said outlet pipe connection;

filter cartridge means for removing particles from the exhaust gas as the exhaust gas flows from said inlet chamber to said outlet chamber, said filter cartridge means being positioned between, and supported by, said inlet mounting plate and said outlet mounting plate, said filter cartridge means includes a support tube also extending between and being supported by said inlet mounting plate and said outlet mounting plate, said support tube being conical in shape having a first end in communication with said outlet chamber and a second end closed off from said inlet chamber, said first end having a diameter larger than a diameter of said second end, and said support tube and including a filter material on an outside radial surface of said support tube, said filter material being of a size to define a free space between said filter material, said housing, said inlet mounting plate and said outlet mounting plate, said support tube passing the exhaust gas between said free space and one of said inlet and outlet chambers, said inlet mounting plate defining openings communicating said inlet chamber with said free space.

10. A filter in accordance with claim 9, wherein:

said filter material is distributed on said support tube to cause a lower flow resistance at said first end of said support tube than at said second end of said support tube.

11. A filter in accordance with claim 9, further comprising:

a heat source means for supplying heat to said filter cartridge means in order to regenerate said filter cartridge means by burning entrapped particles free.

12. A filter in accordance with claim 11, wherein:

flow resistance through said filter cartridge means is varied along said support tube to provide substantially even particle entrapment along said support tube and to provide substantially even and complete burning free of the entrapped particles.

13. A filter in accordance with claim 9, wherein:

one of said inlet and outlet mounting plates have means for sliding said one of said inlet and said outlet plates with respect to said housing.

14. A filter in accordance with claim 9, wherein:

one of said first and second ends of said support tube is slidably connected to one of said inlet and outlet mounting plates.

15. A filter in accordance with claim 9, further comprising:

a plurality of filter cartridge means.

16. A filter in accordance with claim 11, wherein:

said conical shape of said support tube is dimensioned to compensate for a volume flow increase of the exhaust gas along said support tube, and to provide substantially even entrapment and burning free of the entrapped particles.

17. A particle filter for cleaning exhaust gas of an internal combustion engine, the filter comprising;

a housing defining an inlet pipe connection and an outlet pipe connection;

an inlet mounting plate positioned inside said housing and cooperating with said housing to define an inlet chamber in communication with said inlet pipe connection;

an outlet mounting plate positioned inside said housing and cooperating with said housing to define an outlet chamber in communication with said outlet pipe connection;

filter cartridge means for removing particles from the exhaust gas as the exhaust gas flows from said inlet chamber to said outlet chamber, said filter cartridge means being positioned between and supported by said inlet mounting plate and said outlet mounting plate, said filter cartridge means includes a support tube also extending between and being supported by said inlet mounting plate and said outlet mounting plate, said support tube being conical in shape and said conical shape of said support tube is dimensioned to compensate for a volume flow increase of the exhaust gas along said support tube, and to provide substantially even entrapment and burning free of the entrapped particles, said support tube including a filter material on and outside radial surface of said support tube, said filter material being of a size to define a free space between said filter material, said housing, said inlet mounting plate and said outlet mounting plate, said support tube passing the exhaust gas between said free space and one of said inlet and outlet chambers; and a heat source means for supplying heat to said filter cartridge means in order to regenerate said filter cartridge means by burning entrapped particles free.

* * * * *